US006244628B1

(12) United States Patent
Muller

(10) Patent No.: US 6,244,628 B1
(45) Date of Patent: Jun. 12, 2001

(54) TEXT TABBING SYSTEM AND METHOD

(76) Inventor: Peter D. Muller, Norbertine Fathers of Orange, 19292 El Toro Rd., Silverado, CA (US) 92676

( * ) Notice: Subject to any disclaimer, the term of this patent is extended or adjusted under 35 U.S.C. 154(b) by 0 days.

(21) Appl. No.: 09/494,232

(22) Filed: Jan. 31, 2000

Related U.S. Application Data

(63) Continuation of application No. 08/939,015, filed on Sep. 26, 1997.
(60) Provisional application No. 60/027,118, filed on Sep. 30, 1996.

(51) Int. Cl.[7] ..... B42F 21/00
(52) U.S. Cl. ..... 283/38; 283/37; 283/39; 283/40; 283/41; 283/42; 283/43
(58) Field of Search ..... 283/37, 38, 39, 283/40–43

(56) References Cited

U.S. PATENT DOCUMENTS

| | | | | |
|---|---|---|---|---|
| 371,791 | * | 10/1887 | Rosewater . | |
| 533,811 | * | 2/1895 | Hon . | |
| 535,351 | * | 3/1895 | Brashear . | |
| 629,214 | * | 7/1899 | Simpson . | |
| 685,257 | * | 10/1901 | Colvin . | |
| 2,282,939 | * | 5/1942 | Clawson | 40/158 |
| 3,381,654 | * | 5/1968 | Hupp . | |
| 3,463,515 | * | 8/1969 | Thompson | 283/37 |
| 3,780,460 | * | 12/1973 | Hurt, Jr. | 40/78 |
| 3,995,389 | * | 12/1976 | Mathis | 40/360 |
| 4,024,832 | * | 5/1977 | Machnikowski | 116/119 |
| 4,175,777 | * | 11/1979 | Horn | 283/42 |
| 4,680,210 | * | 7/1987 | Corcoran | 428/42 |
| 4,832,374 | * | 5/1989 | Prest, Jr. | 283/38 |
| 4,970,984 | * | 11/1990 | Vazquez | 116/234 |
| 4,978,143 | * | 12/1990 | Ericson | 283/38 |
| 5,103,758 | * | 4/1992 | Clark | 116/237 |
| 5,249,827 | * | 10/1993 | Olson | 283/36 |
| 5,287,823 | * | 2/1994 | Jiang | 116/237 |
| 5,462,006 | * | 10/1995 | Thiruppathi | 116/234 |
| 5,462,783 | * | 10/1995 | Esselman | 428/40 |
| 5,468,085 | * | 11/1995 | Kline | 402/79 |
| 5,500,929 | * | 3/1996 | Dickinson | 395/160 |
| 5,503,435 | * | 4/1996 | Kline | 283/67 |
| 5,506,952 | * | 4/1996 | Choy et al. | 395/159 |
| 5,547,226 | * | 8/1996 | Wenworth | 283/36 |
| 5,641,182 | * | 6/1997 | Schwandt | 283/36 |

* cited by examiner

*Primary Examiner*—A. L. Wellington
*Assistant Examiner*—Alisa L. Thurston
(74) *Attorney, Agent, or Firm*—Knobbe, Martens, Olson, & Bear, LLP

(57) ABSTRACT

A Bible topic referencing system and method using adhesive-backed tabs to locate Bible verses corresponding to various pre-selected topics found in the Bible. The tabs are arranged in linear rows corresponding to a topic and picture icons are contained on the tabs and correspond to the various pre-selected topics.

7 Claims, 6 Drawing Sheets

TEXT TABBING SYSTEM AND METHOD

RELATED APPLICATION

Pursuant to 35 U.S.C. § 119(e), this application claims the priority benefit of Provisional application Ser. No. 60/027,118 filed Sep. 30, 1996 and is a continuation of U.S. patent application Ser. No. 08/939,015, filed Sep. 26, 1997, under 35 U.S.C. § 120.

FIELD OF THE INVENTION

This invention relates to a system and method for very conveniently and quickly locating various topics found in the Bible.

DESCRIPTION OF THE PRIOR ART

As is well known, the Bible is a very widely used and referred to printed work. Systems have been developed in the past to provide Bible indexing systems. One such system uses an index along with the text disclosing the name of a certain book and its location as it is linearly arranged in the text. The reader can then search for the specific Bible verse according to its linear order. Methods are also available for marking verses once the location of the page is known by using either highlighters, luminescent film or colored markers.

U.S. Pat. No. 5,409,753 issued to Roberto J. Perez discloses a system for marking verses in the Bible by placing colored labels or circular stickers next to a verse, Each color may be associated with a particular area or topic of the study. An index chart is provided on the back cover of the text which identifies the topics associated with each color.

U.S. Pat. No. 4,978,143 issued to Thomas H. Ericson discloses a book indexing system intended for texts such as the Bible where the book arrangement is nonalphabetical. The indexing system is provided with adhesive tabs that are attached to the side of pages in a stair-step configuration. The tabs are marked with the particular book's number and its title. Tabs are also provided for certain segments such as Lord's Prayer and Ten Commandments. The system also includes a cover index which is attached to the inside cover of the text disclosing in alphabetical order the names of the books and the corresponding numerical order in the text.

SUMMARY OF THE INVENTION

The present invention provides tabs with picture-icons 2nd text citations arranged in linear rows to locate specific topics in the Bible. Access to a specific verse is made even easier by combining these row-tabs with a circular sticker affixed next to the verse identified by the citation on the tab. Thus, the exact identity and location of a verse can be quickly ascertained from the citation on the tab itself and the circular sticker. The system and method of the preferred embodiment of this invention has the very important advantage of providing convenient, direct and immediate access to a Bible topic notwithstanding that a substantial number of verses correspond to a particular topic. For many individuals, this is of great importance because the sheer multiplicity of verses found in the bible is an obstacle to locating, at least with facility and rapidity, the desired topic-related passages.

Although the preferred embodiment of this invention includes a topic table or menu of contents, a significant feature of this invention is that the picture icons enable the user to bypass using a table of contents or index.

A further advantage of this invention is that it provides for multiple reference of topics of any category in the Bible.

Accordingly, this invention provides for convenient access to a large number of preselected topics, directly and immediately. The invention effectively provides for externally rearranging the text of the Bible and locating Bible verses relating to selected topics without actually physically altering the Bible text. In contrast, the prior art methods and systems discussed above all fail to provide quick and convenient access to those portions of the Bible text relating to a particular topic.

An important feature of the invention is that it provides for locating topics external to the text of the Bible so that a user can ascertain the location of a particular topic without opening the text.

Another significant advantage of the invention is to provide for three ways by which a topic associated with a tab can be identified. One is by the color of the tab. Another is by the icon on the face of a tab. And a third is by reference to a menu affixed to the front cover of the text.

DETAILED DESCRIPTION OF THE PREFERRED EMBODIMENT

Figure 1A:
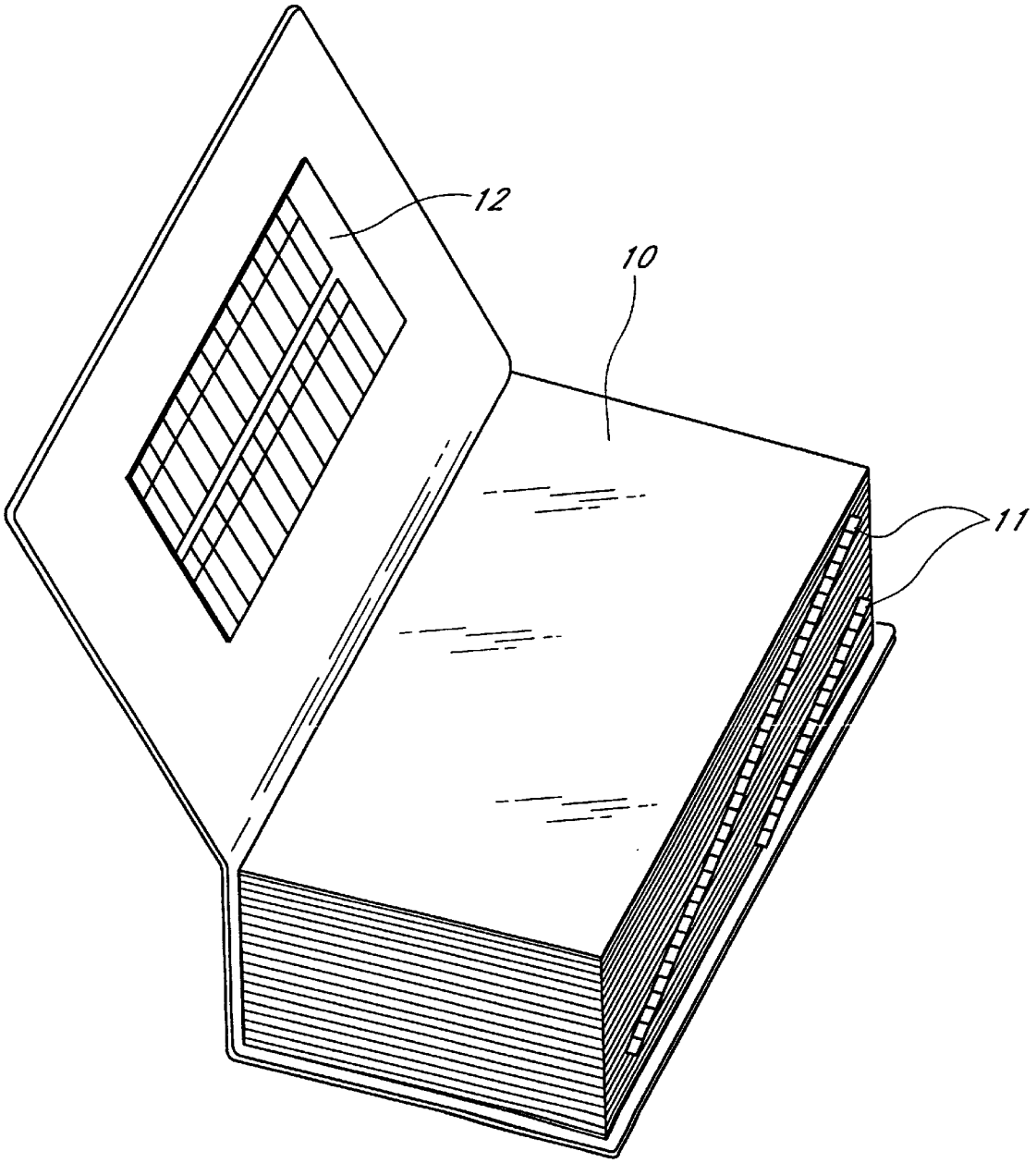
FIG. 1A (PRIOR ART)
FIG. 1A illustrates a prior art Bible indexing system.

A Bible 10 employing the prior art system of the Ericson U.S. Pat. No. (4,978,143) is shown in FIG. 1A. A series of stair-stepped tabs 11 are attached to the outside border of selected pages. An index table insert 12 is attached to the inside of the front cover. Each of the tabs 11 are marked with the number of a particular book of the bible and the title of same. Tabs are also provided for certain segments, such as the Lord's Prayer and the Ten Commandments. The tabs are thus affixed in sequential order in a stair-step manner along the outside border of each page containing the start of a particular book of the Bible or, in the Bible page having such selected segments. The index 12 lists in alphabetical order the names of these books of the Bible, and selected segments, and the corresponding numerical order in the text of same.

The Ericson-type system thus enables the user to locate a book of the Bible by first consulting the index 12 and then locating the tab situated at the start of the sought-after book of the Bible.

However, the stair-step system of Ericson, as well as other prior art Bible indexing systems, merely assist in locating the books of the Bible. These prior art systems fail to (i) offer any assistance in quickly locating Bible text associated with a particular topic found in the Bible or (ii) provide for locating topics external to the text of the Bible so that the user can ascertain the location of a topic without even having to open the text. For example, the prior art Perez U.S. Pat. No. (5,409,753) noted above requires the person reading or studying the Bible to first consult an index chart and then laboriously turn page-by-page looking for colored labels affixed within the body of the Bible text.

Figure 1B:
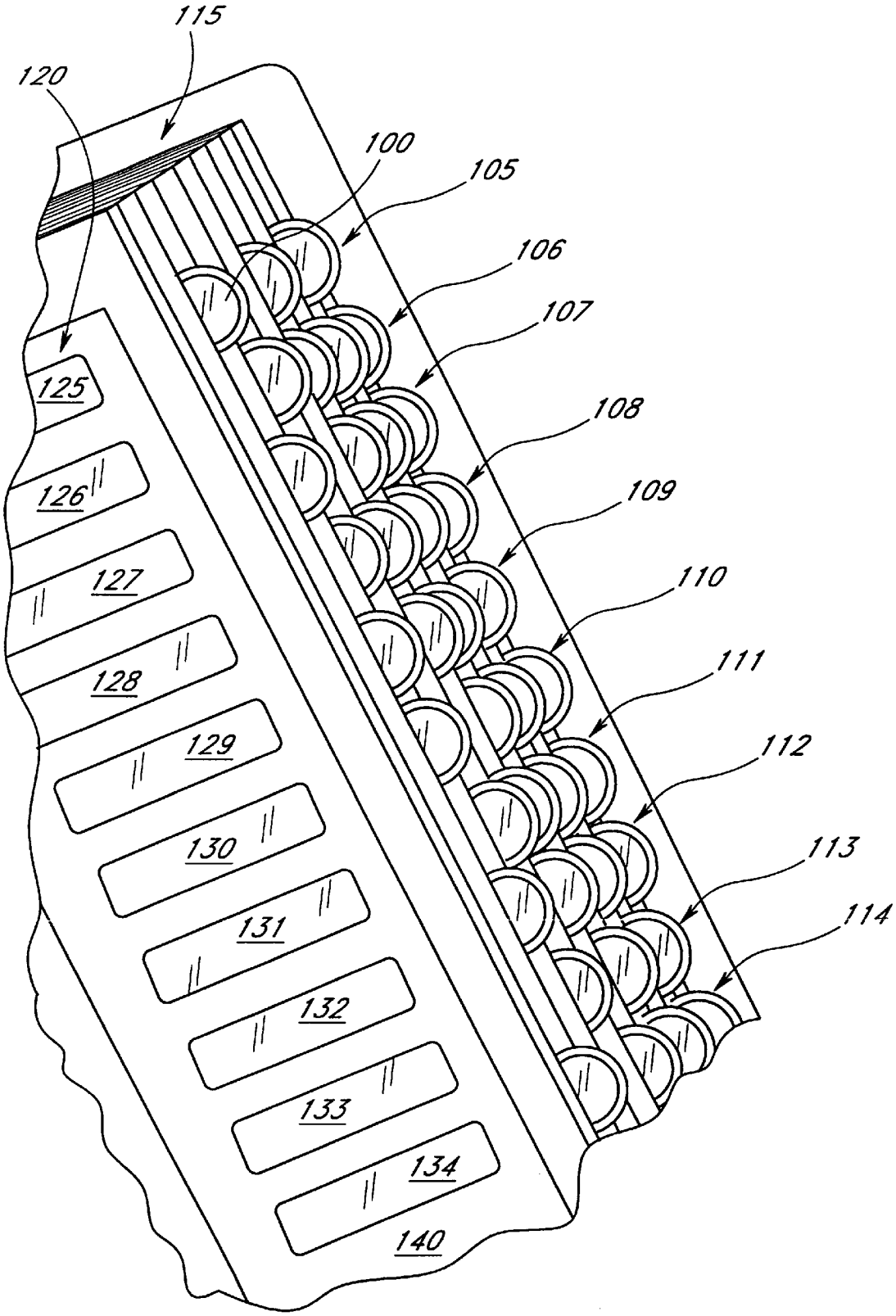
FIG. 1B illustrates a Bible with the system of this invention.

The preferred embodiment of the present invention is shown in FIG. 1B and includes a plurality of row-sets 105–114 of individual tabs 100 affixed to the outer edge of selected pages of the Bible 115. Advantageously, each row-set of tabs is associated with a preselected topic of study or with two or more sub-topics. A topic menu label 120 is provided, listing a plurality of selected topics 125–134 in a single column. Advantageously, the menu 120 is affixed to one of the front pages 140 of the Bible.

Figure 2:
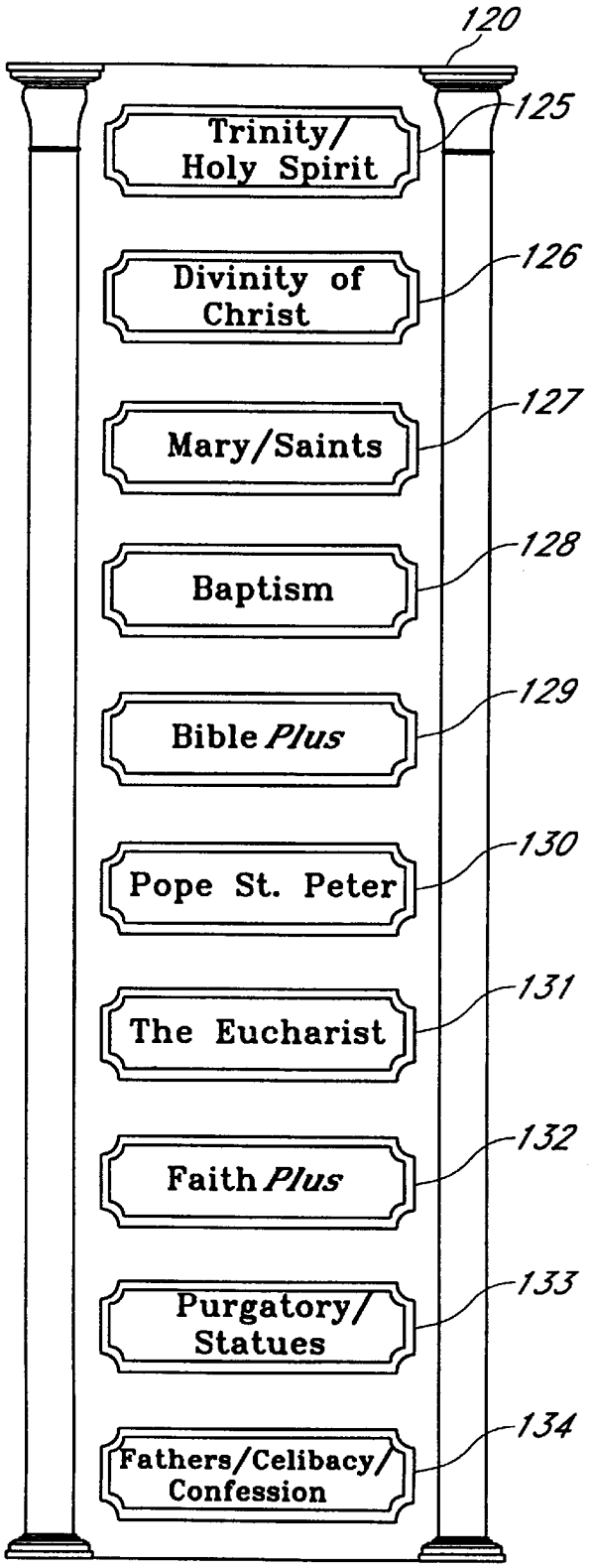
FIG. 2 illustrates the design of a tab of this invention, tab including its color, picture icon, and verse location.

Referring to FIG. 2, menu label 120 is advantageously printed on adhesive backed paper and UV-coated. Each of the topic rows 125–134 are advantageously colored with a different color, running from the top to the bottom of the Bible page to which the label is affixed. As described below, the menu initially serves as a guide to properly line up the row-sets of tabs 100 when they are attached to the Bible pages. Thereafter, the menu 120 provides a ready topic guide for the Bible. As described below, a significant feature of the invention is that the tabs 100 also include sufficient information so that the Bible reader can bypass this menu if he or she so chooses.

Each of the tabs 100 are placed on the right edge of the page corresponding to the location of the verse noted on the tab 105. The alignment of each tab 100 is dictated by location of a topic 125–134 on menu 120 which the tab is associated with. Therefore, sets of tabs 100, respectively, are aligned with the corresponding menu entry topics 125–134 forming plural aligned linear rows or sets of tabs.

Figure 3:
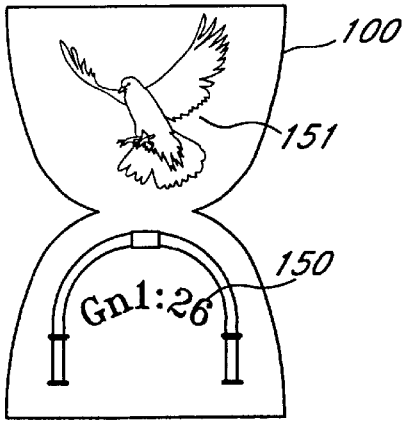
FIG. 3 illustrates a representative topic menu.

FIG. 3 shows one enlarged tab 100 which is shaped like an hourglass which, when folded in the center, forms the "thumbnail" shape gripping the edge of a Bible page as illustrated in FIG. 1A. In the preferred embodiment, the front of the tab 100 references a specific Bible verse 150, and the back of the tab contains a small picture ("icon") 151 symbolizing the topic. Each tab, like each menu entry, also has one of a plurality of different colors which corresponds to one of the colors on the-menu. Thus, for each menu entry there is one color, and one row of tabs with the matching color. Each row 105–114 will typically contain a plurality of tabs. In one specific embodiment of the invention comprising the ten topics shown in FIG. 2, eighty tabs 100 provide the requisite number of references referring to specific Bible pages for these particular selected topics.

Figure 4:
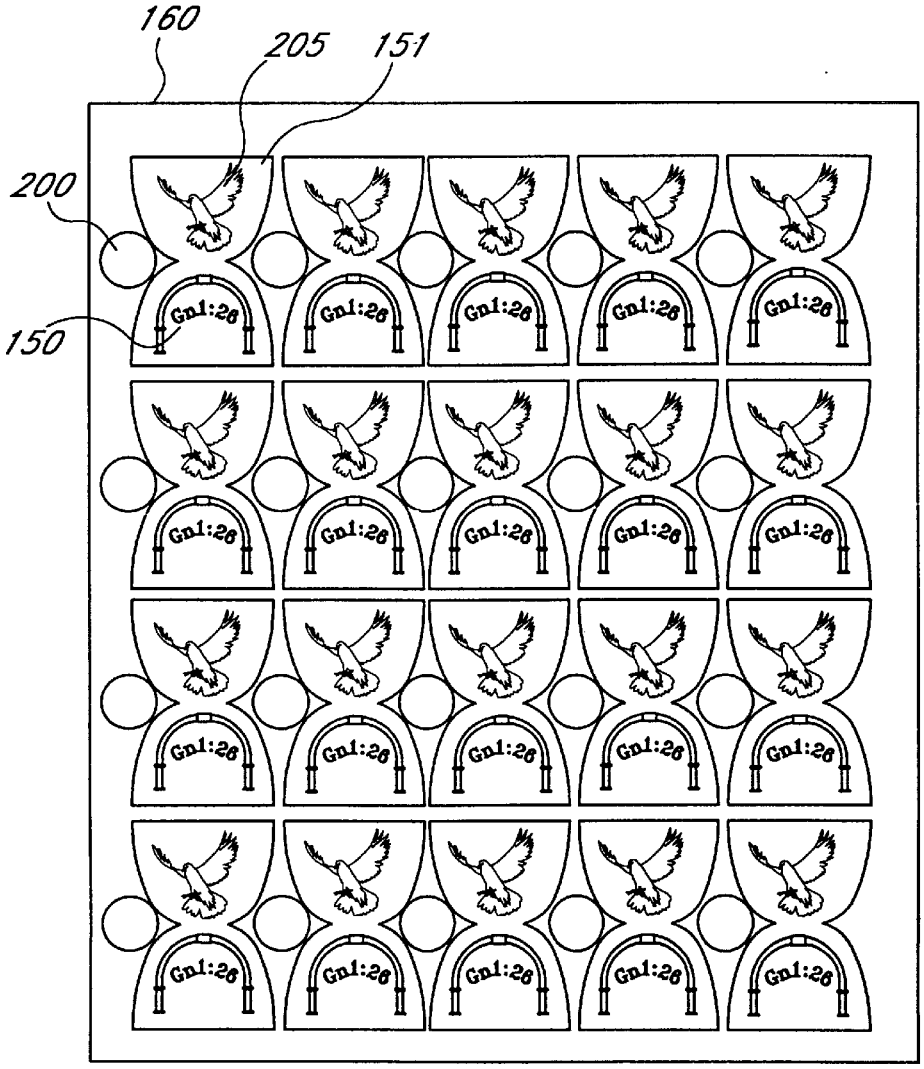
FIG. 4 illustrates a sheet containing plural sets of die cut tabs and circular labels.

FIG. 4 illustrates a plurality of tabs 100 printed on a sheet adhesive backed paper 160, UV coated and die cut. FIG. 4 is for illustrating the manner in which plural tabs are formed on a single sheet 150 and is not meant to show each different tab normally imprinted on the sheet 160. Thus, for illustrative purposes, all of the tabs 100 are shown with the same icon and text citations. In the preferred embodiment of the invention, however, each tab 100 will usually have a different citations and on a given sheet 160 several different icons will be used corresponding to different topics and subtopics. Representative icons are shown and listed in FIG. 5B. Further reference is made to sheets numbered 4 of 6 and 5 of 6 included in the Provisional application Ser. No. 60/027,118 referred to above for specific examples of a plurality of different texts, icons and colors.

As described above, with reference to FIG. 3, each tab 100 within a row-set has three characteristics: color, an icon 151, and text 150. The color of a tab 100 corresponds to the main topic associated with the tab. For example, all the tabs relating to the Trinity and the Holy Spirit may be arbitrarily yellow colored. The icon on the tabs is another way by which a tab 100 is associated with a topic. The topic corresponding to the icon may be uniform for all tabs 100 of a single color or vary between sub-topic of the main topic. For example, in one embodiment of the invention, the yellow tabs include a set of tabs with an icon designating the sub-topic of the Trinity and another set of tabs with another icon designating the sub-topic of the Holy Spirit. Each tab 100 is provided with a textual citation 150 to the location of the verse associated with the topic. For example, a tab 100 for a verse relating to the Trinity can be found in Genesis 1:26 for which the citations "Gn 1:26" will appear on the tab. Therefore, a single tab 100 will externally convey a great deal of information concerning the verse within the text before the user even opens the Bible.

A circular label 200 may be placed directly on and within the tabbed Bible page next to the verse chosen. These circular labels are advantageously die cut on the same sheet 160 containing the die-cut tabs 100. Once the student opens the text to the tabbed page, the circular label 200 will help pin-point the location of the verse avoiding the need to find the numerical citation provided on the tab. For example, referring to tab 205 in FIG. 4, a label 200 would be placed on the page of the Bible at verse Genesis 1:26. These circular labels 200 conveniently share the same color as the tab 100 with which each is associated with.

A significant feature of this invention is that the row-sets of tabs 105–114 greatly facilitates the Bible reader to immediately read and study one of a plurality of topics contained within the Bible merely by first selecting a topic from the menu 120 and then reading all of the verses corresponding to the selected topic. For example, if the topic Holy Spirit is selected, the user can immediately go to the tabbed pages in set 105 having the Holy Spirit icon.

Figure 5A:
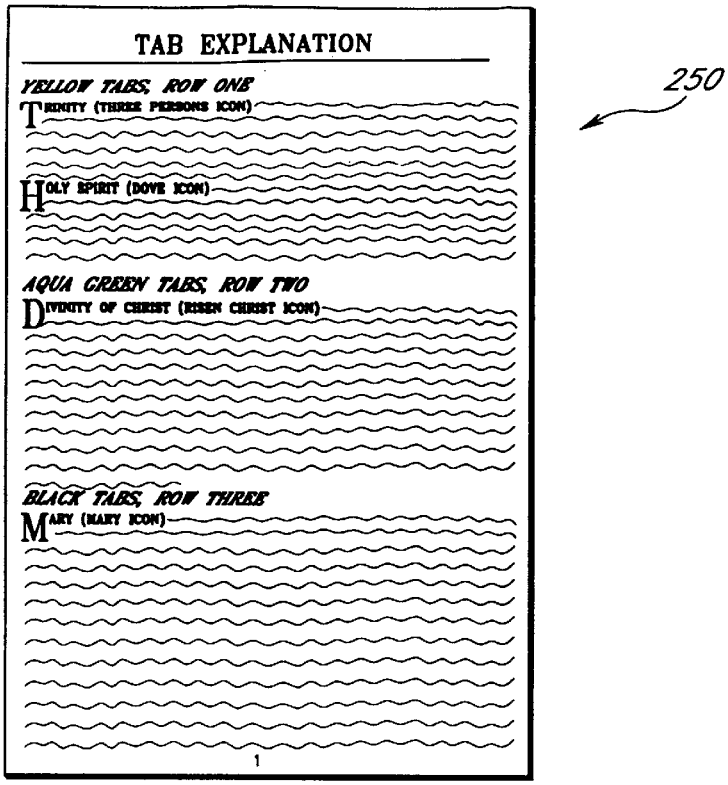
FIG. 5A illustrates the first page of the TAB EXPLANATION booklet used in conjunction with the topic row-tabs of this invention.
Figure 5B:
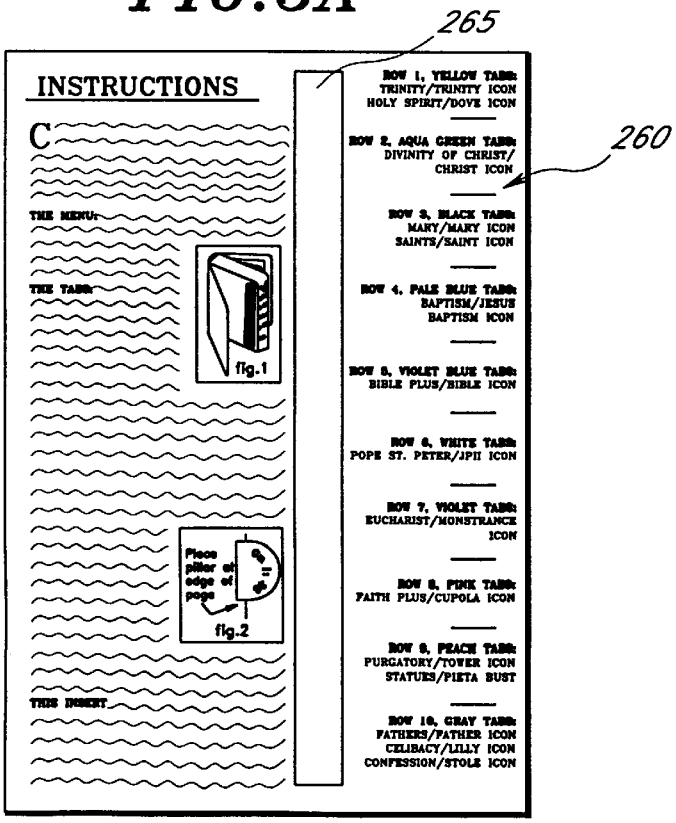
FIG. 5B illustrates the last page of the TAB EXPLANATION booklet with the adhesive strap to affix this booklet to a Bible and the ruler guide to aid in locating the tabs in the proper topic row.

The row sets of tabs 105–114 also facilitate teaching the Bible. As shown in FIG. 5A, a TAB EXPLANATION booklet 250 is advantageously supplied along with the tabs 100 for providing for a narrative as to the meaning of the verses chosen and their importance in the discussion of the corresponding topic. The explanation is a short "exegesis" of the verses identified, explaining the importance of the verse chosen to the topic studied. As shown, separate paragraphs discuss each topic. For rows containing more than one topic, such as first row 105, each topic is readily subdivided into several smaller paragraphs for each topic. On the back side of this insert, there will advantageously be printed an instruction sheet 251 (FIG. 5B) describing the actual placement or installation of the tabs and including a tab guide or ruler 260. Also on this same back side there is advantageously affixed an adhesive strip 265, which when uncovered allows the booklet 250 to be conveniently adhered to a page or back cover of the Bible so as to provide a permanent reference in the back of the Bible.

Representative instructions for placement of the tabs 100 are as follows:

INSTRUCTIONS FOR PLACEMENT

The Menu (FIG. 2): The menu 120 is peeled off and placed on one of the first pages of the Bible, vertically centered, and horizontally along the margin edge. The menu will be used to determine the position of the tabs.

Figure 6:
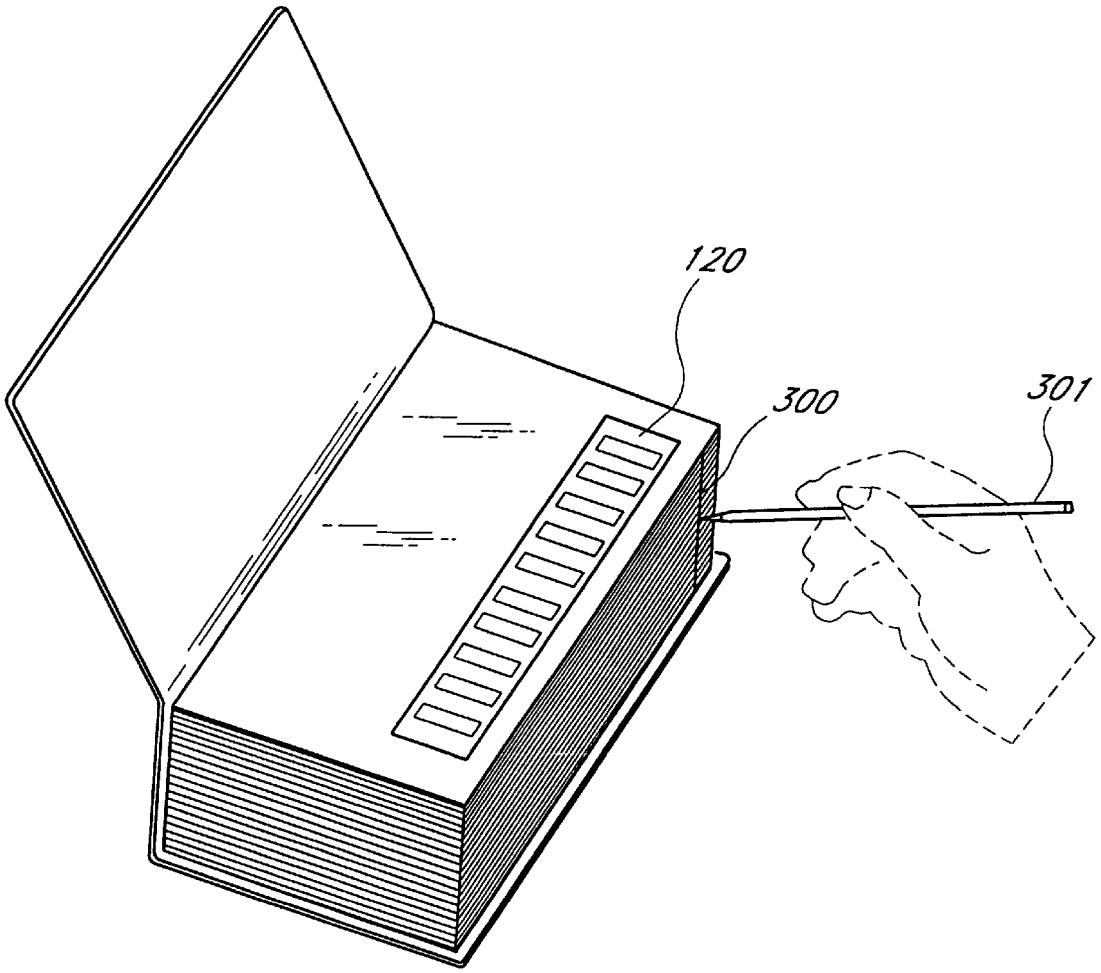
FIG. 6 illustrates the preferred method of positioning the rows of topic tabs.

The Tabs (FIGS. 1B, 3 and 4): The colors of the tabs 100 correspond to the colors/rows of the menu 120. Thus, for every row, there is one color. First, a light pencil line 300 is drawn with pencil 301 from the top right hand corner of the menu across the pages of the Bible (see FIG. 6). This will allow all of the tabs 100 to be lined up, using the measurement guide 260 printed at the right hand side on the back page of instruction sheet (see FIG. 5B). Taking each sheet of tabs, (one being numbered), the Bible is opened to the quote of the first yellow tab (Genesis 1:26 Trinity/Holy Spirit). With a hole punch the colored dot label 200 can be removed and placed by the tabbed verse in the Bible. Now the first tab 100 is ready to be placed. The top right hand corner of the instruction sheet is lined up with the pencil line drawn on the right hand is edge of the Bible. Note that when the Bible is open to the correct verse, its tab 100 must be on the right hand side of the page, with the verse facing up. In other words, regardless of which page of the open bible the verse is found on (left or right), the tab goes on the right page. The tab is placed in its appropriate row using the ruler guide 260. Now the rest of the tabs may be placed, working row by row.

The Insert (FIGS. 5A and 5B): The insert booklet 250 contains an adhesive strip 265 to adhere to the back of the bible. After the protective paper is peeled off, the entire insert may then be placed and adhered to the back inside cover of the Bible 115.

Although the preferred embodiment of the present invention has been described and illustrated are, those skilled in the art will appreciate that various changes and modifications that can be made to the present invention without departing from its spirit. Accordingly, the scope of the present invention is defined only by the following appended claims.

What is claimed is:

1. A method for externally rearranging the text of the Bible for conveniently and quickly locating various topics found in the Bible without opening the Bible comprising the steps of:

selecting a plurality of different topics in the Bible for which a plurality of verses and pages of the Bible correspond to each particular topic, said topics being selected from the following: Trinity/Holy Spirit, Divinity of Christ, Mary/Saints, Baptism, Bible Plus, Pope St. Peter, The Eucharist, Faith Plus, Purgatory/Statues, Fathers/Celibacy/Confession;

placing said topics in a single vertical column to create a topic menu, attaching said topic menu on a front page of a Bible;

drawing a line on the side of the Bible corresponding to the location of each different topic in said topic menu;

positioning a tab locating guide using said drawn line as the reference location;

attaching a first plurality of tabs, in a first linear row aligned with reference to the first selected topic listed in the topic menu, to those edges of the pages of the Bible containing a text portion related to the first topic in said topic menu, each of said tabs protruding from the edge of the Bible page to which they are attached and located in said first linear row, each of said tabs having (i) a citation to a particular part of the Bible text pertinent to said topic, (ii) at least one of a plurality of icons corresponding to sub-topics of said topic, and (iii) a distinct color arbitrarily corresponding to said topic so that the vertical, top to bottom external location of each affixed tab immediately informs the user of the Bible as to the particular topic found on said pages having said first linear row of tabs without the user having to open the Bible;

attaching a second plurality of tabs, in a second linear row aligned with reference to the second selected topic listed in the topic menu, to those edges of the pages of the Bible containing a text portion related to the second topic in said topic menu, each of said tabs protruding from the edge of the Bible page to which they are attached and located in said second linear row, each of said tabs having (i) a citation to a particular part of the Bible text pertinent to said topic, (ii) an icon corresponding to said topic, and (iii) a distinct color arbitrarily corresponding to said topic so that the vertical, top to bottom external location of each affixed tab immediately informs the user of the Bible as to the particular topic found on said pages having said second linear row of tabs without the user having to open the Bible;

attaching additional plurality of tabs, in successive linear rows aligned with reference to successive selected topics listed in vertical order in said menu, to those edges of the pages of the Bible containing a text portion related to respective topics listed in said topic menu, each of said tabs protruding from the edge of the Bible page to which they are attached and located in respective successive linear rows, each of said tabs having (i) a citation to a particular part of the Bible text pertinent to said topic, (ii) an icon corresponding to said topic, and (iii) a distinct color arbitrarily corresponding to said topic so that the vertical, top to bottom external location of each affixed tab immediately informs the user of the Bible as to the particular topic found on pages having said linear row of tabs without having to open the Bible; and affixing dot labels, having the same color coding as said tabs, directly by the Bible text relating to the topic designated by said color.

2. A Bible referencing system comprising a menu attached to the front page of the Bible, in a single vertical column listing topics of study for which a plurality of verses of the Bible correspond to each particular topic, said topics comprising: Trinity/Holy Spirit, Divinity of Christ, Mary/Saints, Baptism, Bible Plus, Pope St. Peter, The Eucharist, Faith Plus, Purgatory/Statues, Fathers/Celibacy/Confession;

a first plurality of sets of adhesive tabs including a citation to one of the topics listed above, each of said second plurality of tabs attached to a selected plurality of pages of the Bible in a first aligned horizontal row which is in vertical alignment with said one of the topics listed on said menu, said tabbed pages of the Bible including different verses of the Bible which correspond to said one topic, each of said plurality of tabs protruding from the edge of the Bible page to which they are attached;

a second plurality of sets of adhesive tabs including a citation to one of the second topics listed above, each of said second plurality of tabs attached to selected plurality of pages of the Bible in a second aligned horizontal row which is in vertical alignment with said second one of the topics listed on said menu, said tabbed pages of the Bible including different verses of the Bible which correspond to said second topic, each of said plurality of tabs protruding from the edge of the Bible page to which they are attached;

additional plurality of sets of adhesive tabs respectively including a citation to other of the different topics listed above, said additional sets being attached to a selected plurality of pages of the Bible in respective aligned horizontal rows which are in respective vertical alignment said with topics listed on said menu, said plurality of tabbed pages of the Bible including different verses of the Bible which respectively correspond to said additional topics, each of said plurality of tabs protruding from the edge of the Bible page to which they are attached;

an additional element of a circular label placed on the page of the Bible next to the verse corresponding to the topic of a tab, the color of said label being the same as the color of said tab attached on the edge of said page; and an additional element of each tab within a set of colored tabs including at least one of a plurality of chosen picture icons symbolizing sub-topics of the topic so that the user of said Bible is immediately informed as to each sub-topic included in the topic designated by the color on the tabbed protruding tabs without opening the Bible.

3. A Bible referencing system comprising:

a topic menu having at least a first column of topics, each topic being associated with a distinct color; and a first plurality of tabs having at least a color portion of the same color corresponding to a first of a plurality of topics and having at least one of a plurality of icons corresponding to subtopics of the first topic;

wherein a first tab of the first plurality of tabs includes a first icon corresponding to a first sub-topic of the first topic, and the second tab of the first plurality of tabs includes a second icon corresponding to a second sub-topic of the first topic.

4. The Bible referencing system according to claim 3, additionally comprising a second plurality of tabs having at least a colored portion of a color corresponding to a second of the plurality of topics, and at least one of a plurality of icons corresponding to subtopics of the second topic.

5. The Bible referencing system according to claim 3, wherein the tabs have adhesive portions.

6. The Bible referencing system according to claim 3, additionally comprising a first plurality of circular labels having a color that is the same as the color associated with the first topic.

7. A Bible referencing system according to claim 3, wherein the plurality of topics are selected from the following: Trinity/Holy Spirit, Divinity of Christ Mary/Saints, Baptism Bible Plus, Pope St. Peter, The Eucharist, Faith Plus Purgatory/Statues, Fathers/Celibacy/Confession.

* * * * *